US010280653B2

(12) United States Patent
Estrada et al.

(10) Patent No.: US 10,280,653 B2
(45) Date of Patent: May 7, 2019

(54) VEHICLE DOOR LATCH WITH ELECTRONIC OVERRIDE

(71) Applicants: Eduardo Estrada, Chihuahua (MX); Daniel Aguirre, Chihuahua (MX); Carlos I. Tostado, Chihuahua (MX); Donald Michael Perkins, Sterling Heights, MI (US)

(72) Inventors: Eduardo Estrada, Chihuahua (MX); Daniel Aguirre, Chihuahua (MX); Carlos I. Tostado, Chihuahua (MX); Donald Michael Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 1042 days.

(21) Appl. No.: 14/341,005

(22) Filed: Jul. 25, 2014

(65) Prior Publication Data

US 2015/0069766 A1 Mar. 12, 2015

Related U.S. Application Data

(63) Continuation-in-part of application No. 13/549,389, filed on Jul. 13, 2012, now Pat. No. 9,194,162.
(Continued)

(51) Int. Cl.
*E05B 77/06* (2014.01)
*E05B 77/12* (2014.01)
(Continued)

(52) U.S. Cl.
CPC ..... *E05B 77/06* (2013.01); *E05B 77/12* (2013.01); *E05B 81/28* (2013.01); *E05B 81/06* (2013.01);
(Continued)

(58) Field of Classification Search
USPC ..... 292/201, 216
See application file for complete search history.

(56) References Cited

U.S. PATENT DOCUMENTS 3,583,741 A 6/1971 Breitchwerdt et al.
3,799,596 A 3/1974 Nozomu et al.
(Continued)

FOREIGN PATENT DOCUMENTS

CN 1946913 A 4/2007
CN 101666192 A 3/2010
(Continued)

OTHER PUBLICATIONS

English Abstract for KR20100077163.
(Continued)

*Primary Examiner* — Carlos Lugo
(74) *Attorney, Agent, or Firm* — Cantor Colburn LLP

(57) ABSTRACT

In one non-limiting embodiment, a latch system for a door of a vehicle is provided. The latch system includes a latch assembly, an accelerometer configured to measure acceleration of the vehicle, and a controller communicatively coupled to the accelerometer. The controller is configured to control an operation of the latch assembly. The controller prevents transition of the latch assembly to a disengaged position when the measured acceleration exceeds a predetermined threshold to facilitate preventing the door from opening.

20 Claims, 13 Drawing Sheets

Related U.S. Application Data

(60) Provisional application No. 61/859,949, filed on Jul. 30, 2013, provisional application No. 61/507,803, filed on Jul. 14, 2011.

(51) Int. Cl.

| | |
|---|---|
| ***E05B 81/28*** | (2014.01) |
| *E05B 81/06* | (2014.01) |
| *E05B 81/34* | (2014.01) |
| *E05B 81/40* | (2014.01) |
| *E05B 81/90* | (2014.01) |

(52) U.S. Cl.

CPC ..... *E05B 81/34* (2013.01); *E05B 81/40* (2013.01); *E05B 81/90* (2013.01); *Y10T 29/49826* (2015.01); *Y10T 292/1043* (2015.04)

(56) References Cited

U.S. PATENT DOCUMENTS

| | | | | |
|---|---|---|---|---|
| 3,969,789 | A | 7/1976 | Wize | |
| 4,422,522 | A | 12/1983 | Slavin et al. | |
| 5,474,339 | A | 12/1995 | Johnson | |
| 5,564,761 | A | 10/1996 | Mizuki et al. | |
| 5,680,783 | A * | 10/1997 | Kuroda | E05B 17/22 292/201 |
| 5,887,466 | A * | 3/1999 | Yoshizawa | B60R 25/1001 292/201 |
| 6,053,543 | A | 4/2000 | Arabia, Jr. et al. | |
| 6,065,315 | A * | 5/2000 | Hoshikawa | H02P 5/68 292/201 |
| 6,089,649 | A * | 7/2000 | Hamada | B60J 5/062 292/201 |
| 6,502,870 | B1 | 1/2003 | Luo | |
| 6,568,741 | B1 | 5/2003 | Leung et al. | |
| 6,648,380 | B1 | 11/2003 | Szablewski et al. | |
| 6,712,409 | B2 | 3/2004 | Monig | |
| 6,783,167 | B2 * | 8/2004 | Bingle | E05B 83/26 292/DIG. 43 |
| 6,923,479 | B2 * | 8/2005 | Aiyama | E05B 41/00 292/201 |
| 7,175,228 | B2 * | 2/2007 | Mrkovic | E05F 15/603 192/35 |
| 7,791,218 | B2 | 9/2010 | Mekky et al. | |
| 8,376,416 | B2 | 2/2013 | Arabia, Jr. et al. | |
| 8,398,128 | B2 * | 3/2013 | Arabia | E05B 77/06 292/1 |
| 8,814,231 | B2 * | 8/2014 | Gandhi | E05B 77/06 292/336.3 |
| 8,967,678 | B2 * | 3/2015 | Rosales | E05B 15/04 292/196 |
| 2002/0163207 | A1 | 11/2002 | Rogers, Jr. et al. | |
| 2003/0006618 | A1 * | 1/2003 | Kalsi | E05B 81/06 292/201 |
| 2006/0261602 | A1 | 11/2006 | Jankowski et al. | |
| 2006/0261603 | A1 | 11/2006 | Cetnar et al. | |
| 2009/0230700 | A1 | 9/2009 | Arabia et al. | |
| 2010/0270815 | A1 * | 10/2010 | Shinoda | E05B 81/20 292/201 |
| 2013/0015670 | A1 | 1/2013 | Perkins | |

FOREIGN PATENT DOCUMENTS

| | | | |
|---|---|---|---|
| CN | 102016207 | A | 4/2011 |
| KR | 1020100077163 | A | 7/2010 |
| KR | 10-2014-0097064 | | 8/2016 |

OTHER PUBLICATIONS

Chinese Office Action for Patent Application No. 201401371284.5; dated Nov. 15, 2016.
English Abstract CN102016207.
English Translation Chinese Office Action for Patent Application No. 201401371284.5; dated Nov. 15, 2016.
Chinese Office Action for Patent Application No. 201401371284.5; dated Mar. 22, 2016; 12 pgs.
English Abstract for CN101666192A—Mar. 10, 2010; 2 pgs.
English Abstract for CN1946913—Apr. 11, 2007; 2 pgs.
English Translation of Chinese Office Action for Patent Application No. 201401371284.5; dated Mar. 22, 2016; 17 pgs.
Non-Final Office Action for U.S. Appl. No. 13/549,389, filed Jul. 13, 2012; dated Mar. 17, 2015; 9 pgs.
CN Office Action for Application No. 2014103712845 dated May 26, 2017.
English Translation CN Office Action for Application No. 2014103712845 dated May 26, 2017.

* cited by examiner

VEHICLE DOOR LATCH WITH ELECTRONIC OVERRIDE

CROSS-REFERENCE TO RELATED APPLICATIONS

This application claims the benefit of U.S. Provisional Patent Application No. 61/859,949 filed Jul. 30, 2013, the contents of which are incorporated herein by reference thereto.

This application is also a Continuation-in-Part Application of U.S. patent application Ser. No. 13/549,389, filed Jul. 13, 2012, which claims the benefit of U.S. Provisional Patent Application No. 61/507,803 filed Jul. 14, 2011, the contents each of which are also incorporated herein by reference thereto.

BACKGROUND

Exemplary embodiments of the present invention relate generally to latches and, more particularly, to latches for vehicles.

Some known vehicles typically include displaceable panels such as doors, windows, hood, trunk lid, hatch and the like which are affixed for hinged or sliding engagement with a vehicle body. Cooperating systems of latches and strikers are typically provided to ensure that such panels remain secured in their fully closed position when the panel is closed.

A door latch typically includes a forkbolt that is pivoted between an unlatched position and a primary latched position. The forkbolt is typically held in the primary latched position by a detent lever that pivots between an engaged position and a disengaged position. The detent lever is typically spring biased into the engaged position and thus, holds the forkbolt in the primary latched position when in the engaged position and releases the forkbolt when it is moved to the disengaged position so that the door can be opened.

The forkbolt is pivoted to the primary latched position by a striker attached to, for example, an associated doorjamb when the door is closed. Once in the primary latched position, the detent lever engages the forkbolt to ensure the assembly remains latched.

Accordingly, it is desirable to provide a latch assembly wherein the detent lever is prevented from inadvertently being moved into a disengaged position.

SUMMARY OF THE INVENTION

In one non-limiting embodiment, a latch system for a door of a vehicle is provided. The latch system includes a latch assembly, an accelerometer configured to measure acceleration of the vehicle, and a controller communicatively coupled to the accelerometer. The controller is configured to control an operation of the latch assembly, and the controller prevents transition of the latch assembly to a disengaged position when the measured acceleration exceeds a predetermined threshold to facilitate preventing the door from opening.

In another non-limiting embodiment, a vehicle is provided. The vehicle includes a door and a latch system for the door. The latch system includes a latch assembly, an accelerometer configured to measure acceleration of the vehicle, and a controller communicatively coupled to the accelerometer. The controller is configured to control an operation of the latch assembly, and the controller prevents transition of the latch assembly to a disengaged position when the measured acceleration exceeds a predetermined threshold to facilitate preventing the door from opening.

In yet another non-limiting embodiment, a method of controlling a latch assembly for a door of a vehicle is provided. The method includes communicatively coupling a controller to the latch assembly, communicatively coupling an accelerometer to the controller, measuring, with the accelerometer, an acceleration of the vehicle, and determining whether or not to disengage the latch assembly based on whether the measured acceleration exceeds a predetermined threshold.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which:

FIG. 18B is a view along lines 18B-18B of FIG. 18A;

FIG. 18D is a view along lines 18D-18D of FIG. 18C;

DETAILED DESCRIPTION

Figure 1:
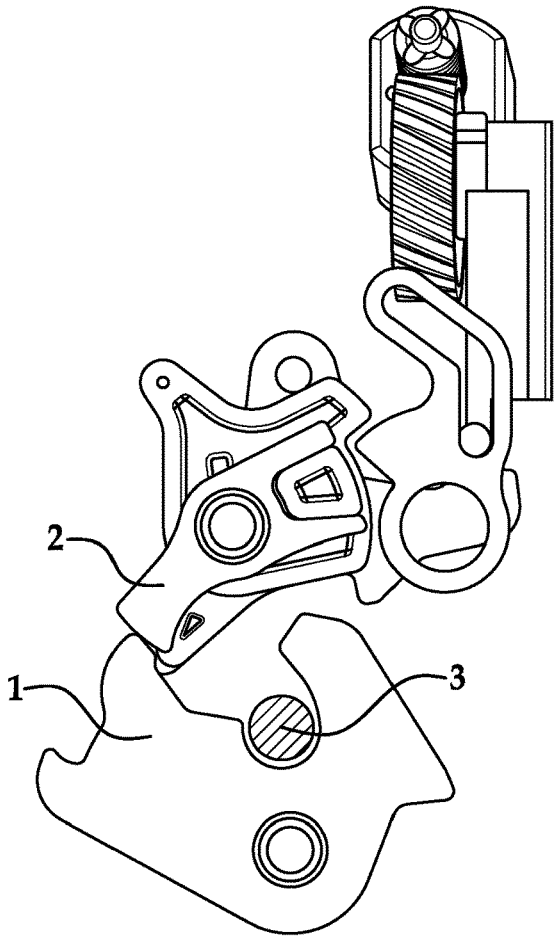
FIG. 1 illustrates a forkbolt and a detent of a vehicle latch in a latched position.
Figure 2:
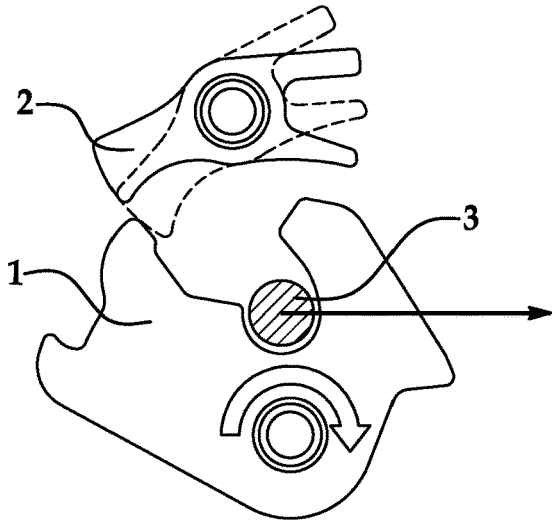
FIG. 2 illustrates a forkbolt and a detent of a vehicle latch in an unlatched position.

Exemplary embodiments of the present invention relate to an apparatus and method for providing a latch assembly. Furthermore, exemplary embodiments are directed to a latch assembly having a forkbolt movably secured thereto for movement between a latched position and an unlatched position. The latch assembly further comprises a detent lever capable of movement between an engaged position and a disengaged position, the detent lever retains the forkbolt in the latched position when the detent lever is in the engaged position and an engagement surface of the detent lever contacts an engagement surface of the forkbolt. The latch assembly also includes an inertia block out assembly having an electronic override control system for preventing the detent lever from moving into the disengaged position until a predetermined force is applied to the detent lever to move it to the disengaged position when the forkbolt is in the latched position and the block out mechanism is disengaged.

The door latch functions in a well-known manner to latch the door when it is closed and to lock the door in the closed position or to unlock and unlatch the door so that the door can be opened manually.

In general terms, the door latch has a forkbolt that engages a striker in the door jamb to latch the door when it is closed and a spring biased detent lever that engages and holds the forkbolt in the latched position. The door latch also typically has a release mechanism for moving the detent to a position releasing the forkbolt so that the door can be unlatched and opened and a lock-unlock mechanism for disabling the release mechanism to prevent unauthorized unlatching of the door.

In one non-limiting exemplary embodiment, the latch assembly is configured to block the detent lever in order to avoid any undesired opening especially when the latch or detent lever could be exposed to a high acceleration.

Reference is made to the following U.S. Pat. Nos. 3,969,789; 6,053,543; 6,568,741; 8,376,416, and U.S. Pat. Pub. No. 2002/0163207, the contents each of which are incorporated herein by reference thereto.

Inertia mechanisms have long been applied to vehicle door latch systems in an effort to control the motion of internal components in the event of a crash condition that would otherwise serve to retain the door to the body of the vehicle.

Since the structural and release mechanisms of most vehicle latches are manufactured from steel or structural thermoplastic resin, they are susceptible to this form of inertial load and thus can release inadvertently.

Some forms of inertia mechanisms employ the use of a counter-balancing mass on a lever that, when a specified level of inertia is encountered, will translate or rotate a blocking member to effectively block out a specific latch or handle component resulting in an enhanced level of inertia performance. Other forms of inertia enhancement systems rely on electromechanical means (motor and gears, solenoid, etc.) to translate or rotate the aforementioned blocking member.

Both of the systems mentioned above have limitations such as the vector to which the inertia is applied, the level of inertia, corrosion, and system deformation.

One possible solution to the aforementioned inertial energy application is to employ a responsive system, much like air bag technology that is currently used in nearly every new vehicle produced. This type of system would react to energy levels instantaneously applied to the vehicle via a response from a form of sensory signal. Issues arise with this methodology due to the time required for said sensory event. Data shows that inertial loads created in a side impact crash event can happen nearly instantaneously, often breaching 10 mS. This brings into light the necessity of a reactive system that can sense, process and deliver an electric signal to a device that could effectively enhance the ability to a door latch system to retain the passenger door of a vehicle in this time window. Experts agree that the process time alone of such a system would be greater than the 10 mS target, thus making them ineffective for all side impact events.

Another sort of inertial energy mitigation device could come in the form of a more active system that senses the vehicle motion or velocity, as an example, to engage an electromechanical system. This approach could greatly enhance the capability of any vehicle to withstand not only greater inertial loads from a crash or rollover event, but to withstand undesired release activation due to deformation of the vehicle body or the related mechanical release system. This deformation can also cause the aforementioned inadvertent release of a vehicle door latching system. In either case, a reactive or active system, the desire is to be able to release the system after a crash event occurs. This would ease the egress of passengers possibly trapped in the vehicle after a crash or rollover event. This would entail a system that would reset itself after an event, or be capable of being mechanically overridden when desired.

It is therefore the purpose of this application, to define a desired system capability, and a method to achieve the desired performance. In addition, this application will describe a control system and method of electromechanically overriding a crashworthiness enhancement system, such that a passenger in a vehicle that encountered a crash or rollover event can release the latching system post-event.

Figure 20:
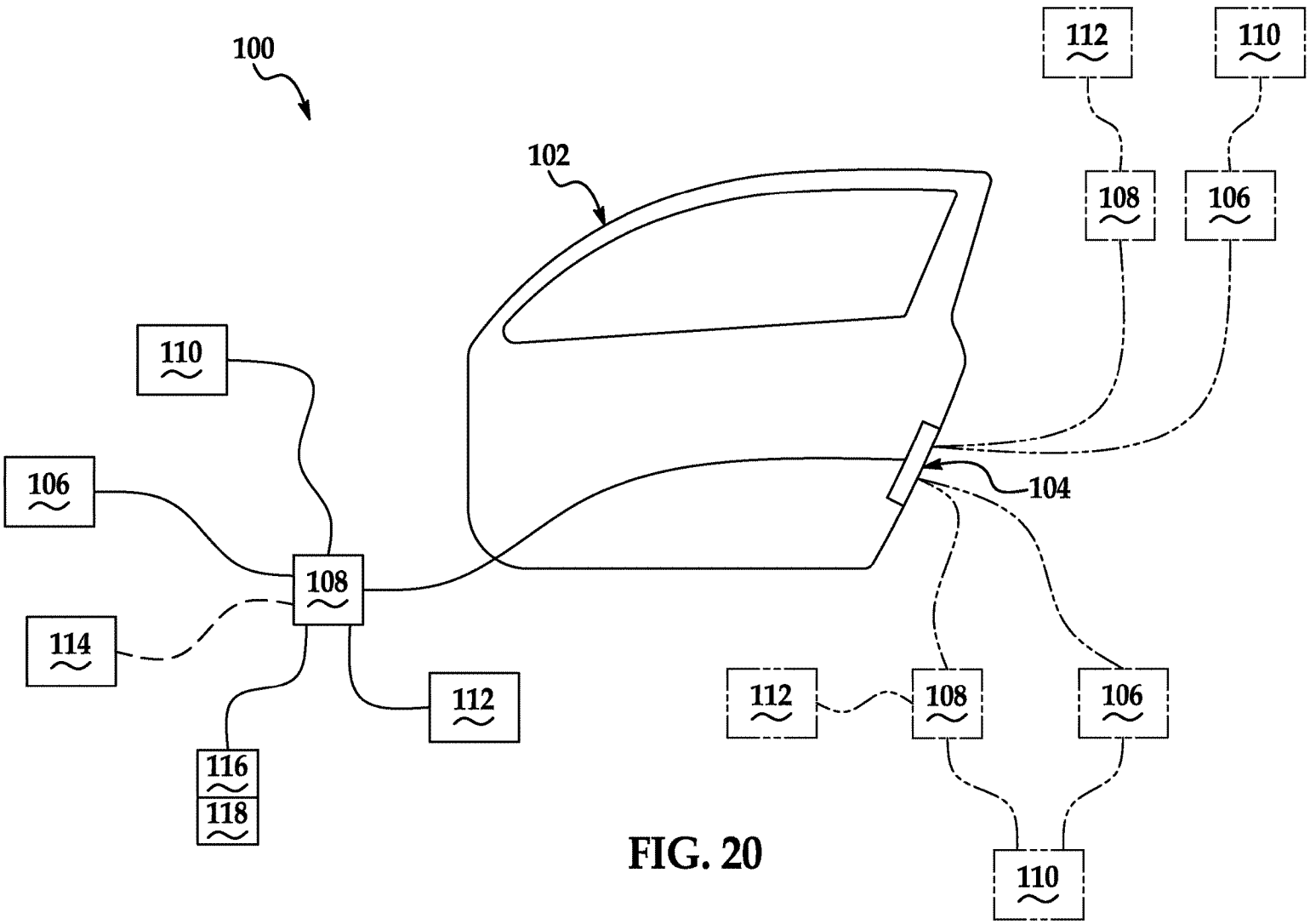
FIG. 20 is a latch system for a door of a vehicle in accordance with an embodiment.

FIG. 20 illustrates a perspective view of an exemplary latch system 100 for a door 102 of a vehicle. In the exemplary embodiment, latch system 100 generally includes a Crashworthiness Enhancement System (CES) or latch assembly 104, a vehicle body controller 106, a door controller 108, a main power supply 110, a backup power supply 112, and an accelerometer 114. Latch assembly 104 is coupled to main power supply 110 and backup power supply 112 to facilitate a transition between engaged and disengaged positions with door 102. Vehicle body controller 106 controls various components and functions of the vehicle.

In one embodiment, power supplies 110 and 112 are in series with controllers 106 and 108 such that vehicle body controller 106 is master and door controller 108 is slave. However, power supplies 110, 112 and controllers 106, 108 may have any suitable arrangement that enables system 100 to function as described herein. For example, two alternate arrangements 150 and 160 (shown in phantom) are illustrated in FIG. 20.

In the exemplary embodiment, controller 108 is a dedicated control for latch assembly 104. However, vehicle body controller 106 may at least partially control latch assembly 104. In the exemplary embodiment, controller 108 is configured to determine if main power supply 110 is present and/or observe if a power supply loss has occurred with main power supply 100. Moreover, controller 108 is configured to switch the power source for operation of latch assembly 104 from main power supply 110 to backup power supply 112 when main power supply 110 is insufficient. For example, controller 108 may switch to backup power supply 112 when main power supply does not have enough voltage to transition latch assembly 104 between engaged/disengaged positions. However, controller 108 may switch to backup power supply 112 in response to any condition or state of the vehicle that enables latch system 100 to function as described herein.

In the exemplary embodiment, main power supply 110 is a vehicle battery, and backup power supply 112 is an auxiliary battery and/or a capacitor. However, main power supply 110 and backup power supply 112 may be any suitable power supply or electrical energy storage solution that enables latch system 100 to function as described herein.

In the exemplary embodiment, controller 108 determines whether main power supply 110 is present and available to change the state of latch assembly 104 from a position which blocks the aforementioned detent lever from moving to the unlatched position, to a disengaged position which enables normal function of the detent lever. If the power is available from main power supply 110 (i.e., no power loss), controller 108 operates latch assembly 104 using main power supply 110. If controller 108 determines a loss of power from main power supply 110 such that main power supply 110 is insufficient to change the position of latch assembly 104 between the engaged and disengaged positions, controller 108 operates latch assembly 104 using backup power supply 112. Although described as a backup, power supply 112 may also be used to power other components or operations of the vehicle or latch system 100.

In the exemplary embodiment, latch system 100 may further include a G-sensor or accelerometer 114 to monitor external acceleration forces, which is communicatively coupled with controller 108. Accelerometer 114 measures the inertia or acceleration of the vehicle and/or door 102 from any vector or rotation and provides such measurements to controller 108. During a crash event, particularly in roll over conditions, latch assembly 104 may disconnect from main power supply 110 transition to a disengaged state. However, the vehicle may still be moving with a high acceleration or inertia. Accordingly, it is desirable for latch assembly 104 to remain in the engaged position until the vehicle reaches a suitable or predetermined low acceleration or inertia. As such, controller 108 prevents or disables disengagement of latch assembly 104 when the measured acceleration exceeds a predefined threshold. Alternatively, controller 108 is configured to receive signals from accelerometer 114 and, based upon the signal, make a determination whether or not latch assembly 104 should be disengaged, as is described herein in more detail.

Figure 21:
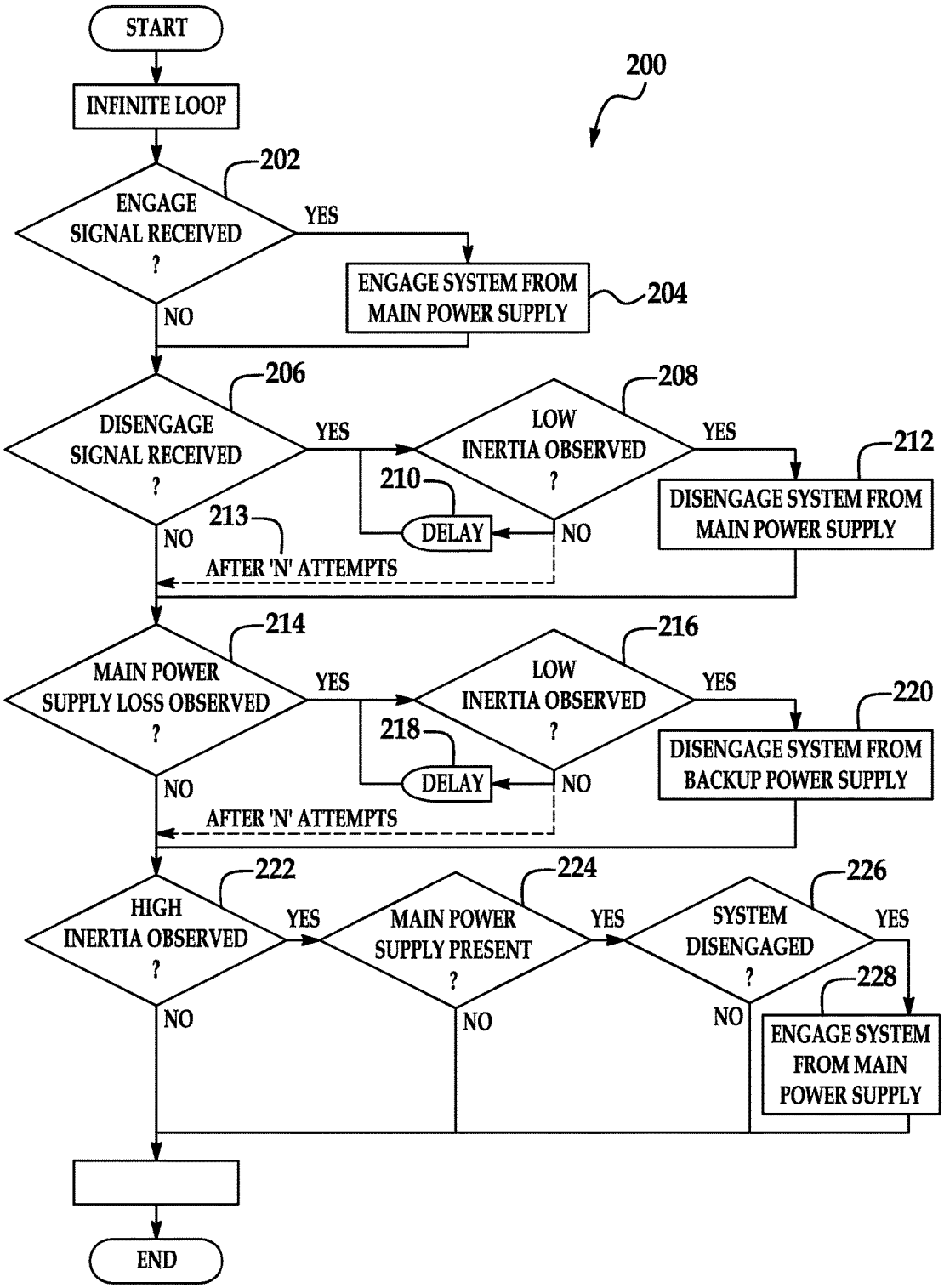
FIG. 21 is a flow chart that schematically illustrates an exemplary method of operating the latch system shown in FIG. 20.

In the exemplary embodiment, controller 108 includes a processor 116 and a memory 118 configured to execute an algorithm for controlling latch assembly 104. However, controller 108 may include any suitable components for running and executing the algorithm. With reference to FIG. 21, an exemplary method of controlling latch assembly 104 is illustrated by a schematic flowchart 200 representing the exemplary algorithm loop. At step 202, controller 108 determines if an engage signal has been received. If the engage signal is received, controller 108 attempts to control latch assembly 104 to engage a latch (not shown) in a latched position. The engage signal may originate from vehicle body controller 106, for example. However, controller 108 may receive the engage signal from any suitable component associated with the vehicle. At step 204, latch assembly 104 is powered to the engage position by main power supply 110 if the engage signal is received in step 202. At step 206, controller 108 determines if a disengage signal has been received. If the disengage signal is received, controller 108 attempts to control latch assembly 104 to disengage the latch. Further, controller 108 determines at step 208 whether a low inertia is observed by accelerometer 114. If external acceleration forces exceed a predetermined threshold, controller 108 delays at step 210 and repeats the inertia observation at step 208 for an 'n' number of attempts. Otherwise, if the observed external acceleration does not exceed the predetermined threshold, at step 212 controller 108 attempts to move latch assembly 104 to the disengage position utilizing power from main power supply 110. If acceleration levels exceed the predetermined threshold after 'n' attempts as related to elapsed time, the signal is passed back to the main logic trunk at step 213.

At step 214, controller 108 determines if a power supply loss from main power supply 110 is observed. If a power supply loss is observed beyond a predetermined parameter (i.e., main power supply 110 cannot provide enough power to transition latch assembly 104 to the disengage position), latch assembly 104 does not disengage utilizing main power supply 110, and controller 108 determines at step 216 whether a low acceleration level is observed by sensor 114. If low acceleration is not observed, controller 108 delays at step 218 and repeats the acceleration observation at step 216 for an 'n' number of attempts. Otherwise, if the observed acceleration does not exceed a predetermined threshold, at step 220 controller 108 attempts to move latch assembly 104 to the disengage position utilizing power from backup power supply 112.

To further enhance security, a failsafe loop may be added to the algorithm if a main power supply loss is not observed at step 214. As such, at step 222, controller 108 determines if a high acceleration is observed. At this point, latch assembly 104 may be disengaged to facilitate opening of door 102 and enabling a passenger to exit the vehicle. However, controller 108 determines whether it is safe for latch assembly 104 to actually be disengaged (i.e., whether the vehicle is traveling at a safe speed or has come to a stop). Accordingly, if high acceleration above a predetermined threshold is observed, controller 108 determines if power from main power supply 110 is present at step 224. If the power is present, and controller 108 determines that latch assembly 104 is disengaged at step 226, controller 108 engages latch assembly 104 utilizing main power supply 124 at step 228. Accordingly, loop 200 may be repeated continuously to ensure proper engagement and disengagement of latch assembly 104 based on the inertia or acceleration levels and/or vehicle velocity observed by accelerometer 114, the power supply level of main power supply 110, the power supply level of backup power supply 112, latch assembly status (engaged or disengaged), and signal(s) received from the vehicle.

In the exemplary embodiment, loop 200 may be continuously repeated to monitor and ensure proper position of Crashworthiness Enhancement System (CES) 104 by observing vehicle speed, acceleration levels, main power supply health, backup power supply health, position sensor input from the CES itself, or other sensory input form the vehicle. Furthermore, controller 108 can monitor the health of the backup energy supply 112 and restore it to proper levels by directing energy from the main power supply 110 to the backup power supply 112 or limiting the flow of energy when required.

Exemplary embodiments of latch assembly 104 are illustrated in FIGS. 1-19. However, latch assembly 104 may have any suitable construction that enables latch system 100 to function as described herein. Moreover, any number of latch assembly configurations can be utilized that have a mechanical latch, traditional detent, and spring latching of a forkbolt lever or other future or existing mechanical or electromechanical arrangements that release with at least one motor actuating detent. However, the release could be accomplished with or without a cinch, detent or other features as long as the door is released upon activation and held in a substantially closed position prior to the release.

FIG. 1 illustrates a typical layout of a forkbolt 1 and a detent 2 of a vehicle latch in a latched position. A striker 3 is represented in this FIG. by a cross section. If the detent lever 2 is rotated to the open position illustrated in FIG. 2, the forkbolt 1 would then be free to rotate to its open position thus releasing the striker 3 from the latch.

Figure 3:
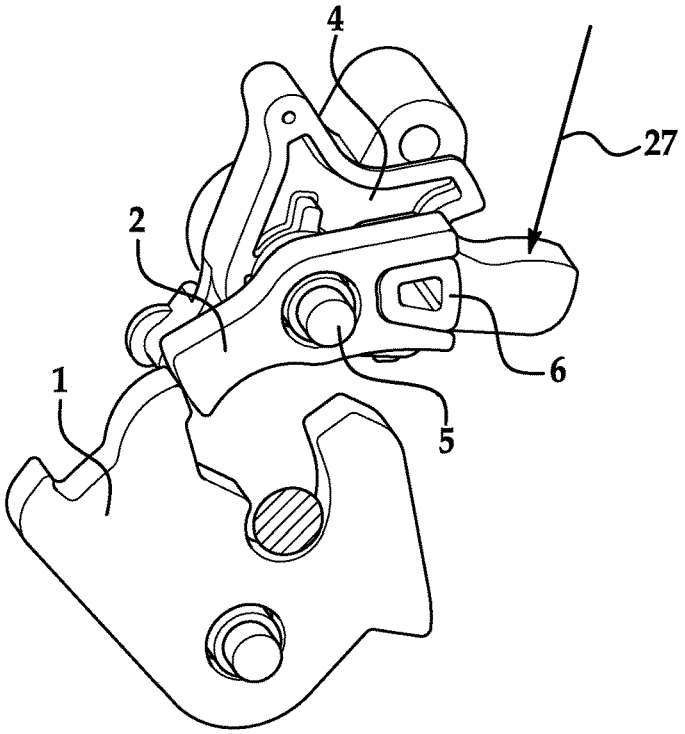
FIG. 3 illustrates a latch with a second lever rotating upon the same pivot as the detent lever.

Referring now to FIG. 3, consider a second lever 4 rotating upon the same pivot 5 as the detent lever 2 and coupled to the detent lever 2 by a feature 6 such that the two members rotate in an exact manner.

Figure 4:
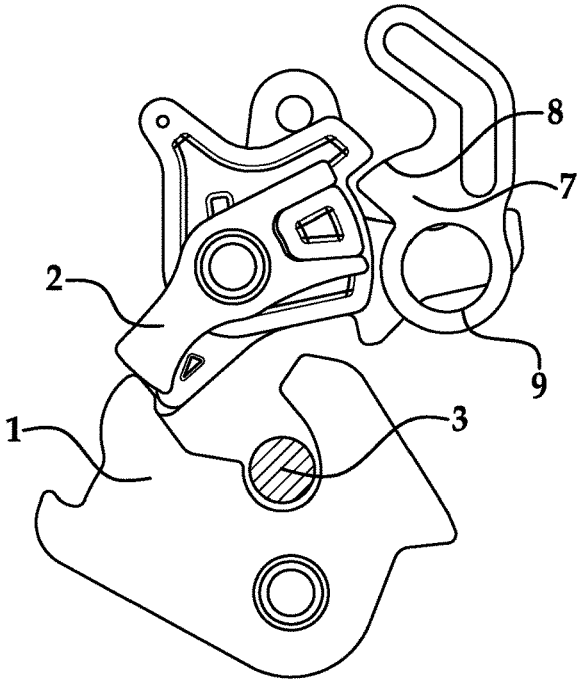
FIG. 4 illustrates a latch with a rotatable blocking member that impedes rotation of the detent lever to its open position when the blocking member is in the position illustrated in FIG. 4.

Still further and referring to FIG. 4, a blocking member 7 is provided and is able to rotate in such a manner that a portion 8 of the blocking member 7 impedes rotation of the detent lever 2 to its open position when the blocking member 7 is in the position illustrated in FIG. 4. The blocking member 7 is secured to, and pivots about a structural feature 9 of the door latch such that it will withstand any inertial loads which would otherwise serve to release the detent lever.

Figure 5:
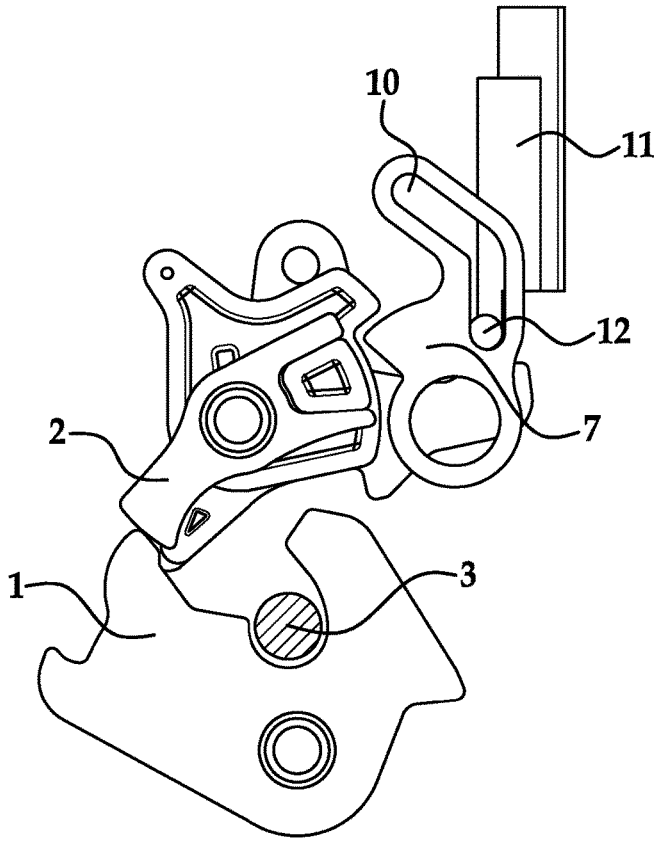
FIGS. 5 and 6 illustrate a linear cam arrangement or opening integral with the blocking member of the previous FIGS.
Figure 6:
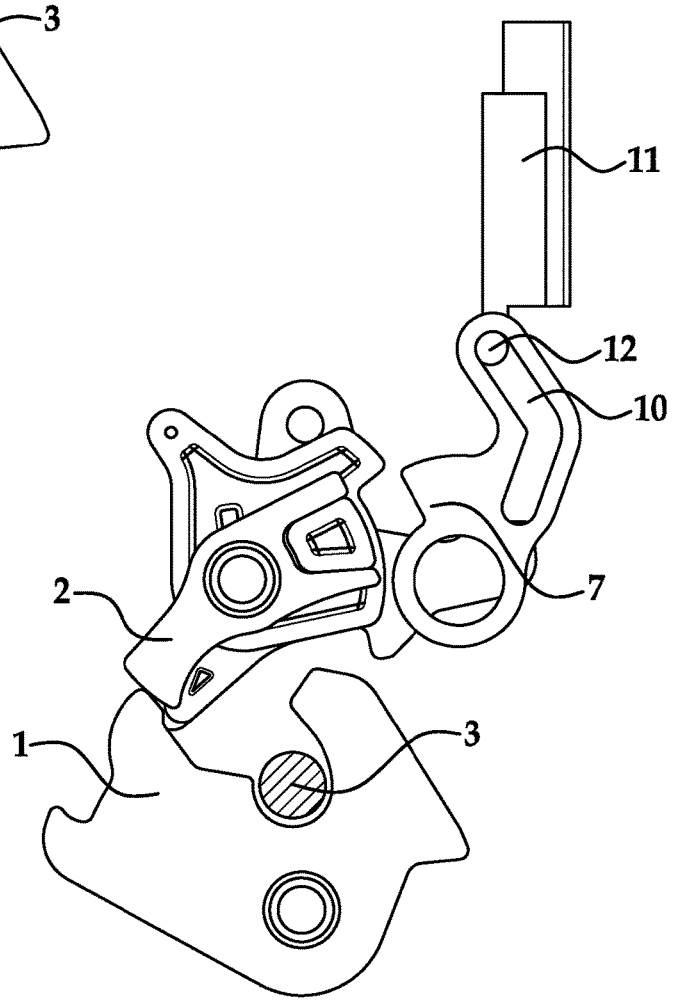

FIGS. 5 and 6 illustrate a linear cam arrangement or opening 10, integral with the aforementioned blocking member 7. In one contemplated embodiment, a sliding rack 11 has an integral cam driving feature 12 that interfaces or slides within the linear cam feature 10 of the blocking member, such that movement of the cam driving feature 12 in the cam feature 10 will rotate the blocking member 7 to a desired position when the sliding rack 11 is translated as depicted in FIGS. 5 and 6.

Figure 7:
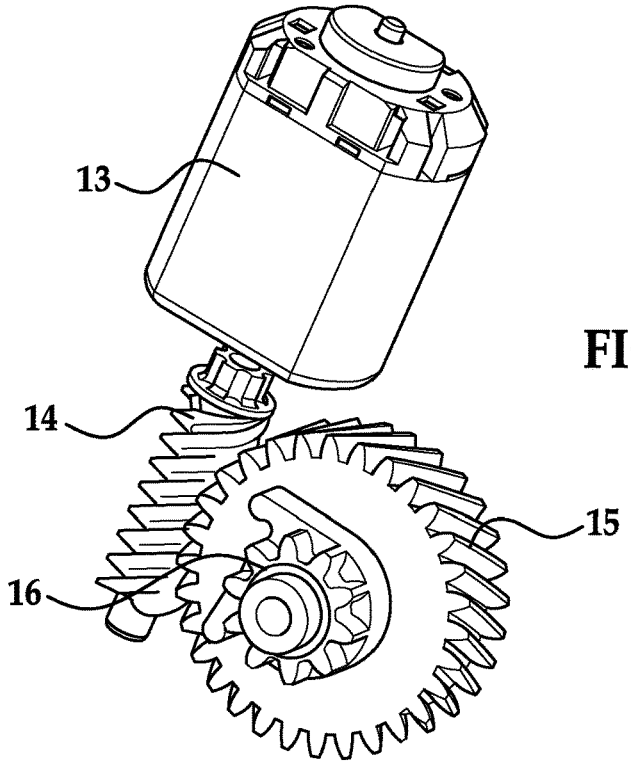
FIG. 7 illustrates an electromotive motor for use with a latch.
Figure 8:
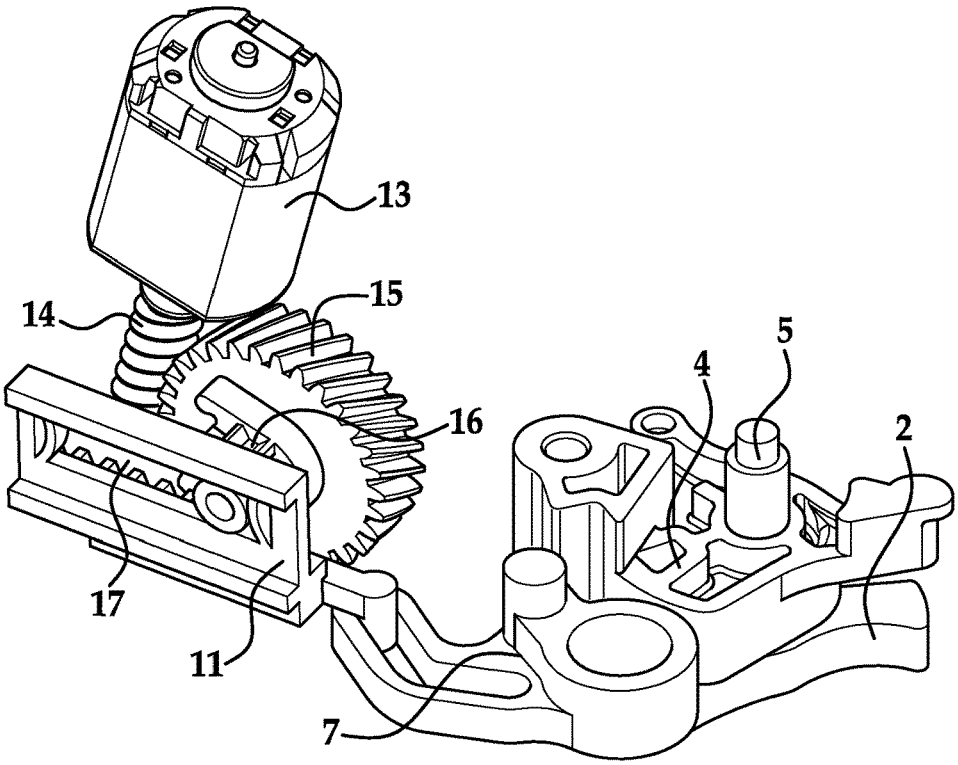
FIG. 8 illustrates the electromotive motor coupled to a sliding rack.

FIG. 7 illustrates an electromotive motor 13 that is coupled to a worm gear 14 that interfaces with a helical gear 15. Integral with the helical gear is a spur gear 16. FIG. 8 illustrates the electromotive motor 13 coupled to the sliding rack 11. Here the spur gear 16 is configured to interface with integrally molded gear teeth 17 on the sliding rack 11. Accordingly, the electromotive motor 13 can selectively place the blocking member 7 in the desired position to either operate in a conventional manner or block out the release direction of the detent lever thus negating the effect of inertia on the detent lever.

Figure 9:
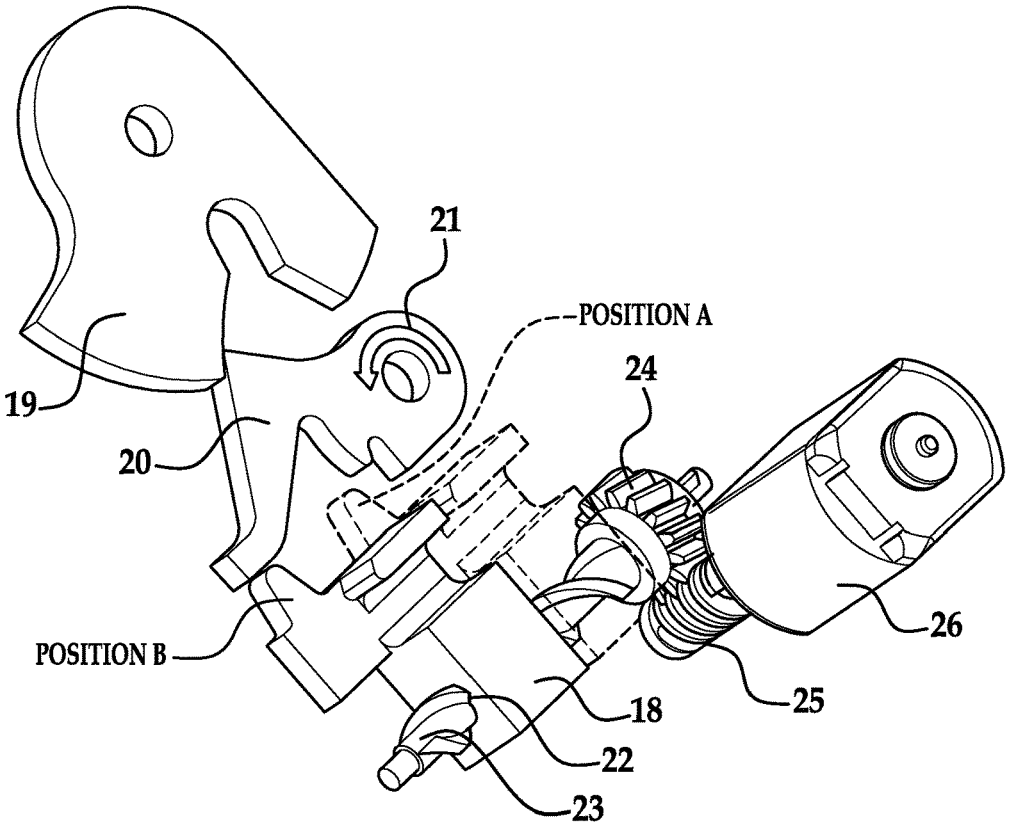
FIG. 9 illustrates an alternative exemplary embodiment of the present invention.

FIG. 9 illustrates an alternative exemplary embodiment of the aforementioned methodology. Here a translating blocking member 18 is used as opposed to a rotating blocking member. FIG. 9 also illustrates another forkbolt 19 and detent 20 geometry along with a release direction 21 of the detent lever. If the translating blocking member 18 was to travel to position A shown in dashed lines of FIG. 9, it is in a position to allow for the detent to move and function in a normal fashion. If however, the blocking member 18 is in the position B, the detent lever release direction would be compromised and thus blocking member 18 prevents travel of the detent to its release position.

In order to translate the blocking member 18 between positions A and B an integral, internal threaded portion 22 is provided. The internal threaded portion 22 is configured to interface and be driven by a power screw member 23 which allows the blocking element 18 to be selectively driven to a desired position by rotating the power screw member 23. In one non-limiting embodiment, the power screw member 23 has an integral helical gear 24 configured to interface with a worm gear 25, that is mechanically coupled to an electric motor 26. Accordingly, selective rotation of the motor would cause the subsequent translation of the blocking element into the desired positions.

While the systems shown in FIGS. 1-9 illustrate two possible solutions to enhance the load mitigation of inertial events, it does not address the potentially abusive load conditions that arise when a vehicle encounters a side impact collision. The deformation of the vehicle body during a side impact collision is often enough to deform the release cable or rod in such a manner as to release the mechanism or cause the sheet metal to impact the latch itself. Either one of these scenarios can cause extremely high loads upon the release system. One can imagine that if a blocking member were to be engaged with the detent lever under this type of loading condition, permanent deformation or catastrophic failure of the latch release system could easily occur. Therefore, it would be a more robust solution if the latch release mechanism were to be decoupled, in addition to the blocking member restraining the detent lever from moving to its release position.

For example, and referring to the forkbolt and detent lever geometry as described previously in FIGS. 1-3 a force 27 applied to this lever hereinafter referred to as the detent release lever 6 from the release mechanism would cause a rotation on the detent lever to its release position due to the permanent coupling between these two members.

Figure 10:
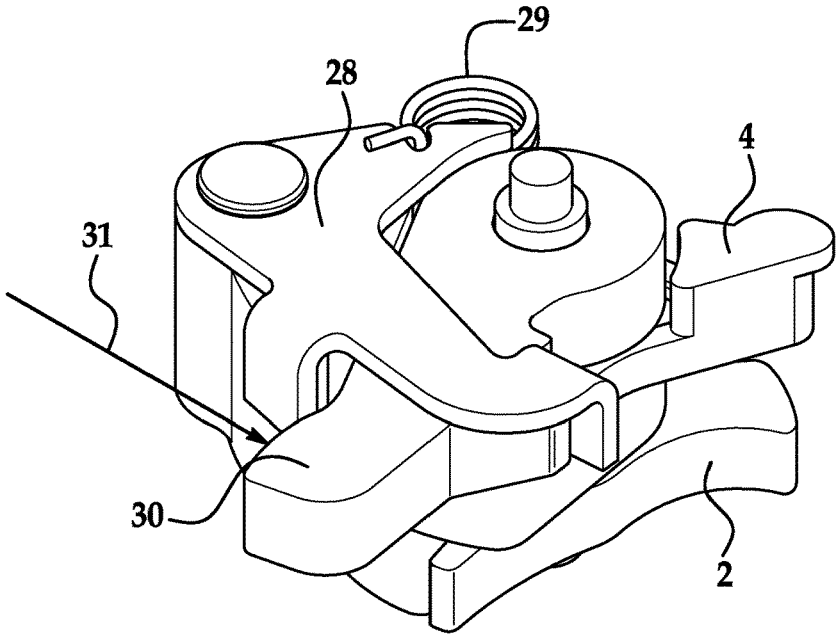
FIGS. 10-13 illustrate one possible non-limiting embodiment of such a decoupling device in accordance with one non-limiting embodiment of the present invention.

In an alternative embodiment, the detent release lever 6 is clutched to the detent blocking member 7 such that movement of the detent blocking member 7 also decouples the detent release lever 6 from the release mechanism. FIG. 10 illustrates one possible non-limiting embodiment of such a decoupling device. In this embodiment, the decoupling device comprises a detent release lever 4, a clutch lever 28, a return spring 29, and an input lever 30 movably displaced by the latch release mechanism represented by vector 31.

Figure 11:
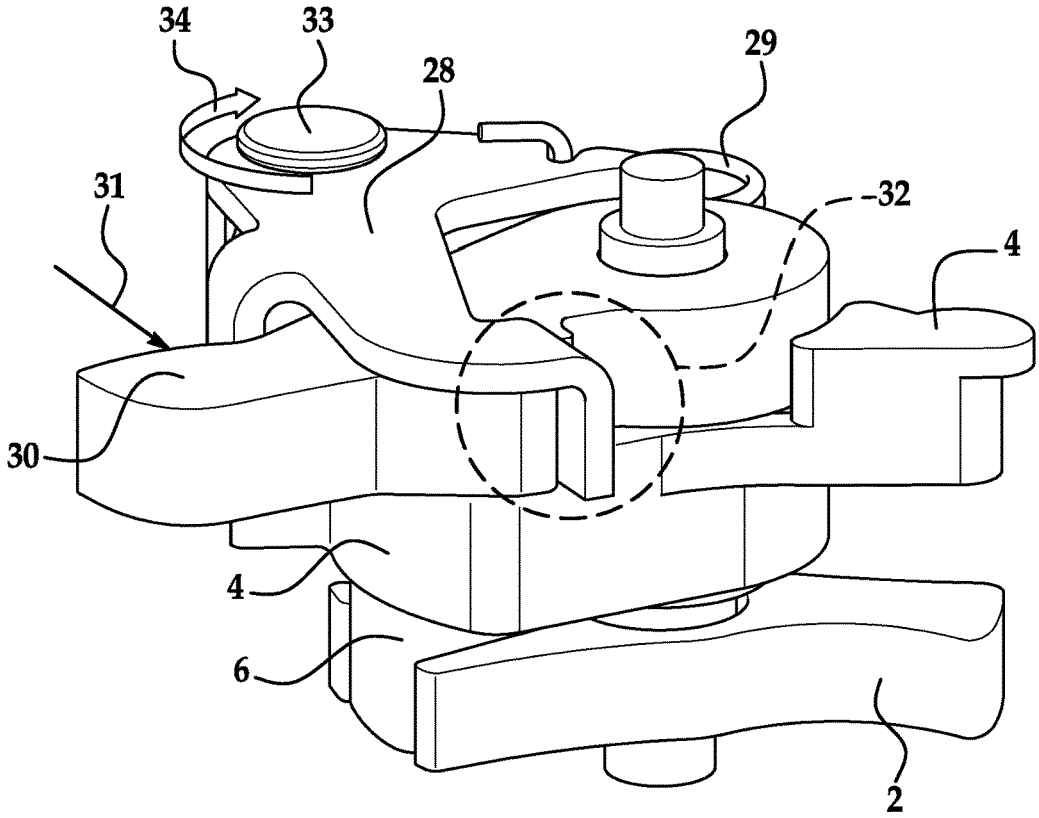

FIG. 11 depicts the detail between the detent lever 2, the detent release lever 4 and the input lever 30 shown in the engaged position 32. The detent release lever and the input lever are able to move independently unless they are coupled together via the clutch lever 28. The clutch lever is pinned to the detent release lever via a pin 33 such that it will travel rotationally with the detent release lever and can also rotate about pin 33. The clutch lever is spring biased in the direction of arrow 34 into the engaged position.

Figure 12:
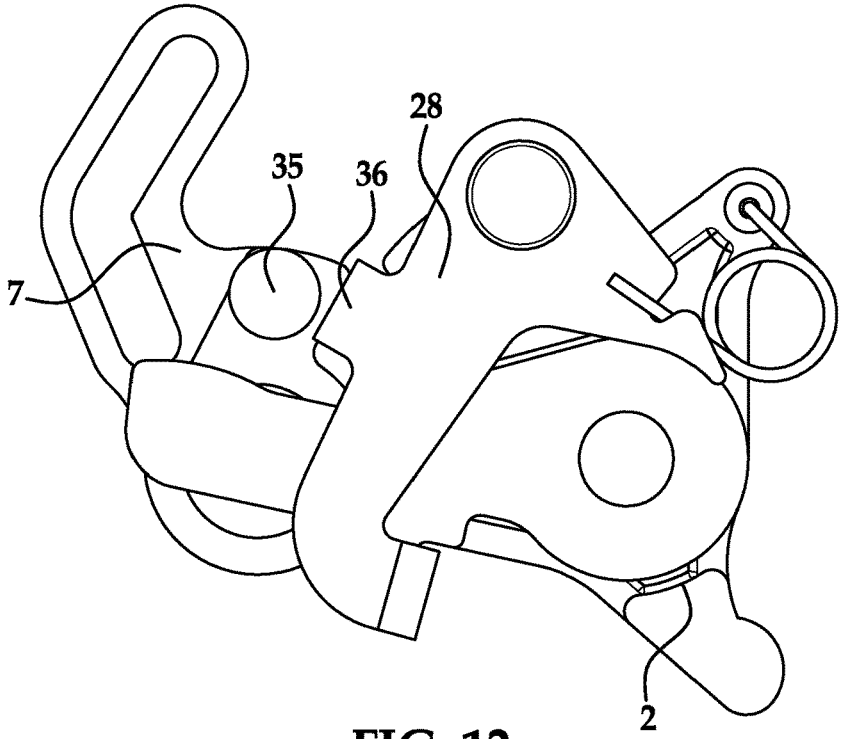
Figure 13:
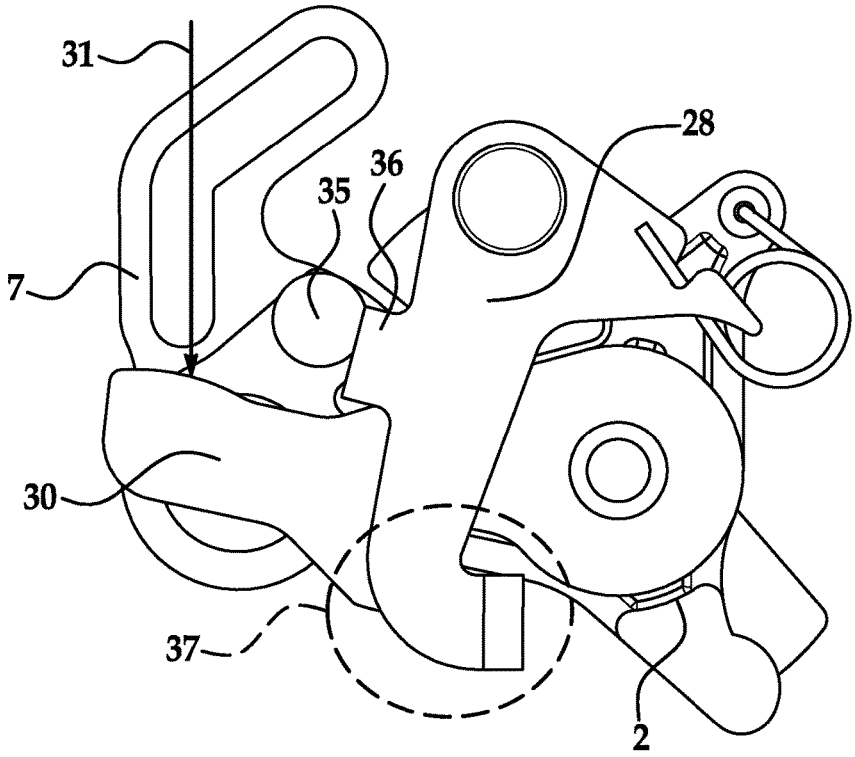

FIG. 12 illustrates the detent blocking member 7 having an integral feature 35 configured to interface with a mating contact surface 36 of the clutch lever 28. Accordingly, rotation or translation of the blocking member 7 to its engaged position FIG. 13 drives the clutch lever 28 to a position such that the detent release lever and the input lever are now decoupled as illustrated by area 37. Once the input lever 30 is decoupled from the detent release lever, movement or a force from the latch release mechanism in the direction of arrow 31 would not be transferred to the detent lever or the blocking member and thus the abusive stresses that would normally be caused from inadvertent release activation are removed from the latch.

To this point, it has been assumed that the electric motor will receive energy via a controller to engage or disengage the blocking member. If however, the blocking member is engaged and an event occurs that severs power to the controller or to the vehicle door latch, a passenger will not be able to open the door under any normal circumstance. Therefore and in one exemplary embodiment, a manual over ride system, or energy back up system, is provided in the event of such an occurrence.

When considering a manual over ride mechanism for a detent lever blocking/release mechanism decoupling device, an issue of relevance occurs. If a passenger or inadvertent release activation were able to disengage the blocking member, it would defeat the purpose of this invention which is to greatly enhance the inertial and crashworthiness performance of the vehicle. However, when subjected to the stresses of a crash event, a human is less likely to process the required steps to reveal an auxiliary release mechanism and instead defaults to the existing release handle. Therefore, an over ride mechanism somehow co-joined to the conventional release mechanism is desirable. However, in a crash or rollover event there may be several inertia impulses or linkage activation events capable of releasing the door latch mechanism that could over ride the blocking member if the over ride mechanism were co-joined to the conventional release chain of the door latch.

Accordingly and in one exemplary embodiment, a feature of this manual over ride methodology requires multiple release motions to return the blocking member to its disengaged position and allow egress from the vehicle. For example, the design illustrated in FIG. 14 uses a three release motion methodology; however any number of release motions could theoretically be implemented.

Figure 14:
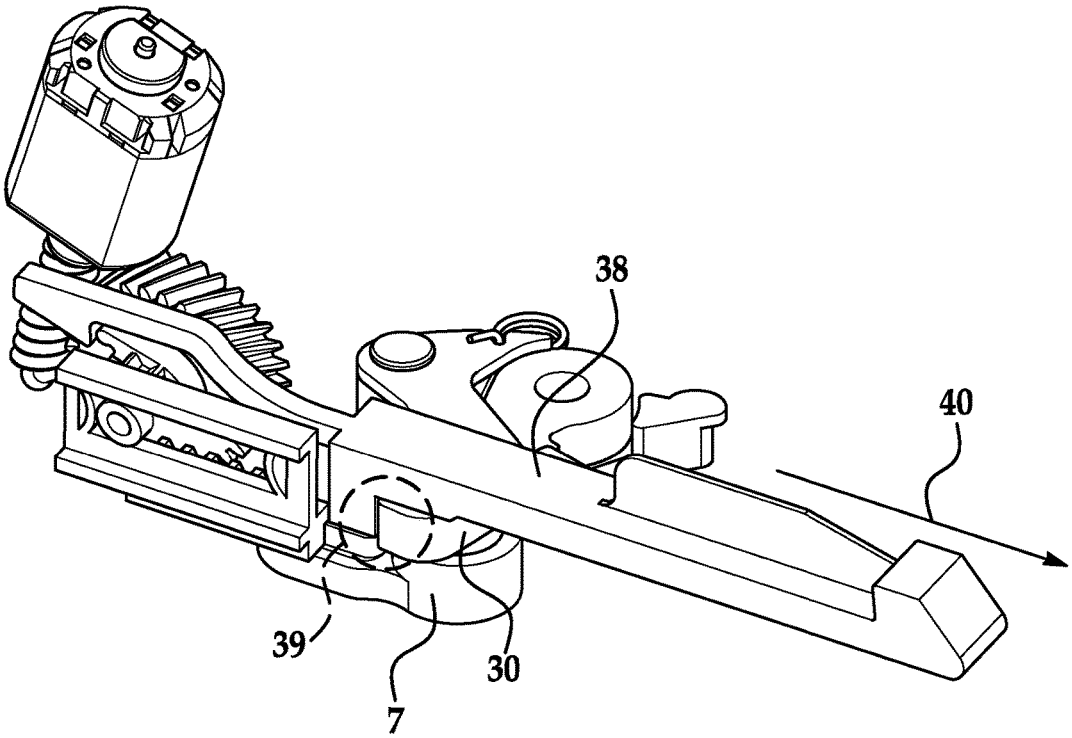
FIGS. 14-17 illustrate an alternative exemplary embodiment of the present invention.

For example, and referring to the motor/worm gear/helical gear arrangement as previously depicted in FIG. 7 and referring to FIG. 14, a release mechanism lever or link 38 interfaces see area 39 with the input lever 30 of the detent release mechanism 38 such that translation of the release link 38 in the direction of arrow 40 would transfer work energy to the detent, thus releasing the door. However, this only occurs when the detent blocking member is disengaged.

In the event of an engaged detent blocking member 7, the force of the release mechanism input would provide no work or movement to the detent.

Figure 15:
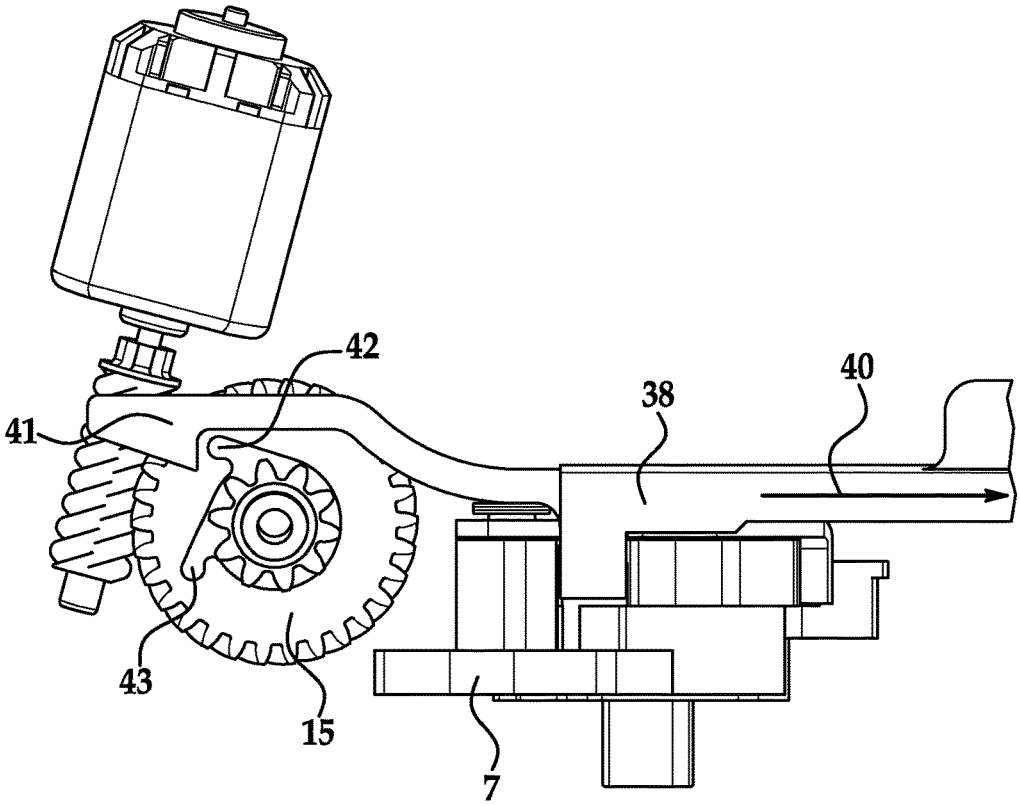

Referring now to FIG. 15, the release link 38 is also configured to have a feature 41 that interfaces with a complementary back drive feature 42 integral to the helical gear 15. As depicted and in one exemplary embodiment the feature is an integral, flexible feature, however, a separate component could be adopted to perform the same function. When the blocking member 7 is engaged such that such translation of the release link 38 would provide no force or work to the detent, the helical gear would be in a specific location relative to the position of the blocking member thus exposing the feature 42 or back drive "cogs" labeled as 42 and 43 for engagement with the release link 38.

Thus, if the release link 38 and its associated interface feature 41 are translated in the direction of arrow 40 to the release position FIG. 16 the link interface feature 41 would engage the gear back drive feature 42 and subsequently rotate the helical gear 15 in the direction of arrow 44. This would cause the helical gear 15 to move a predetermined amount, thus translating the driving rack 11 coupled to the helical gear 15 a predetermined distance. This back drive motion of the helical gear 15 would then expose the next cog 43 of the integral back drive features for engagement by release link 38 when it is moved a second time.

Figure 16:
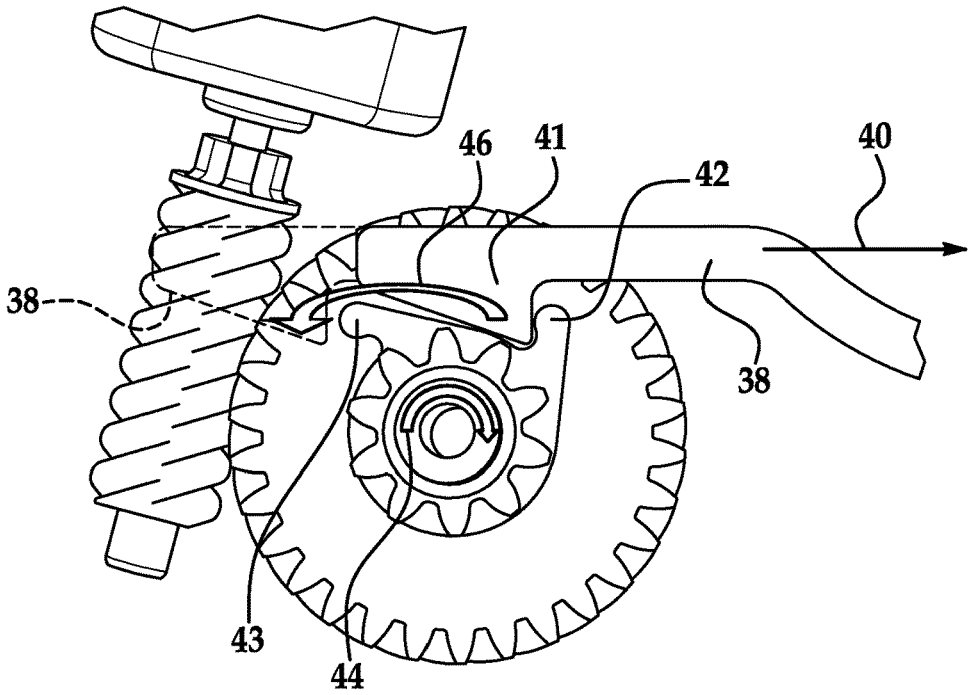

Accordingly and upon returning the release link 38 back to its home position illustrated by the dashed lines in FIG. 16, the link interface feature 41 would index over the cog 43 in the direction of arrow 46 and the subsequent back drive feature 43 on the helical gear thus re-engaging the back drive mechanism to the helical gear 15 such that subsequent release motions applied to the release link would cause the helical gear 15 to be "ratcheted" back to its disengaged position.

Once the helical gear 15 is in the disengaged position, translation of the release link 38 in the direction of arrow 40 would transfer work energy to the detent, thus releasing the door. Accordingly, the system illustrated in FIGS. 14-17 employs a three release motion event to fully release the latch from the vehicle body.

Figure 17:
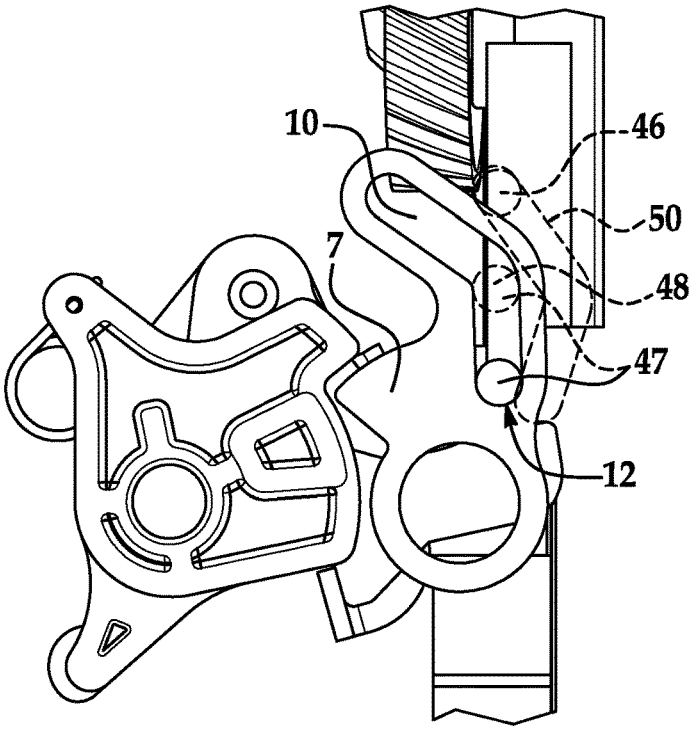
Figure 18A:
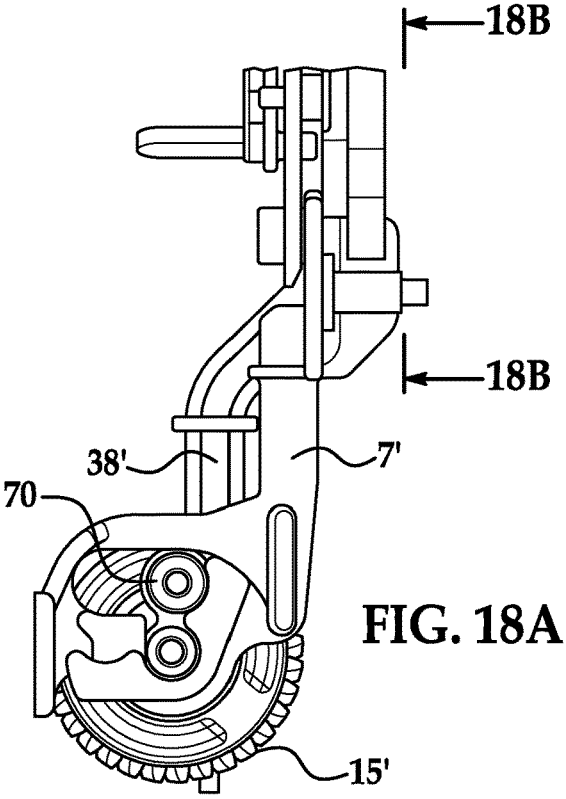
FIGS. 18A-18E illustrate yet another alternative exemplary embodiment of the present invention.
Figure 18B:
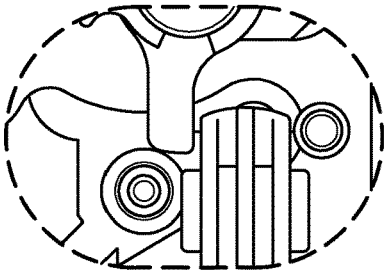
Figure 18C:
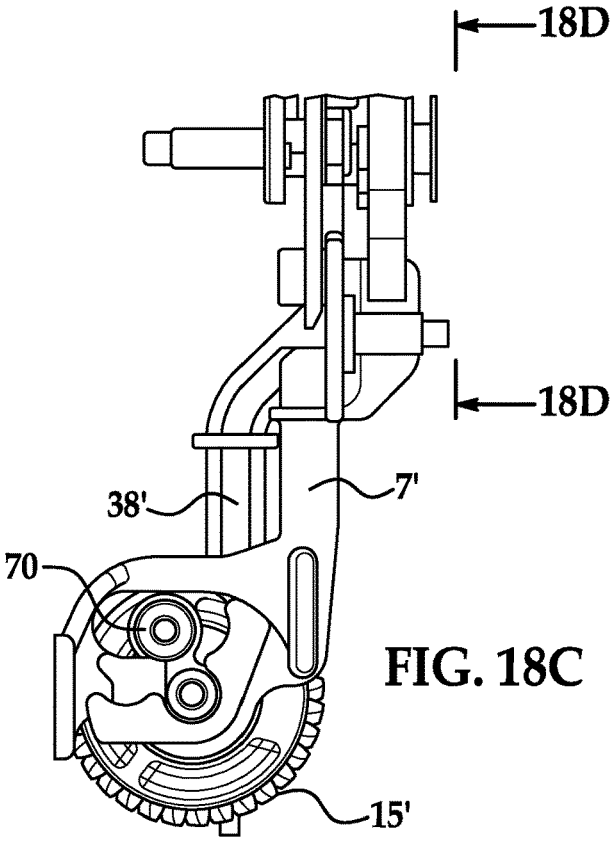
Figure 18D:
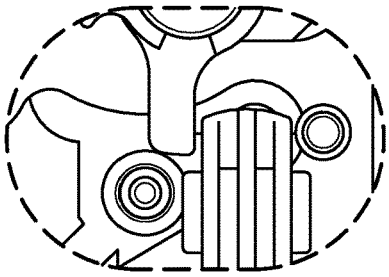
Figure 18E:
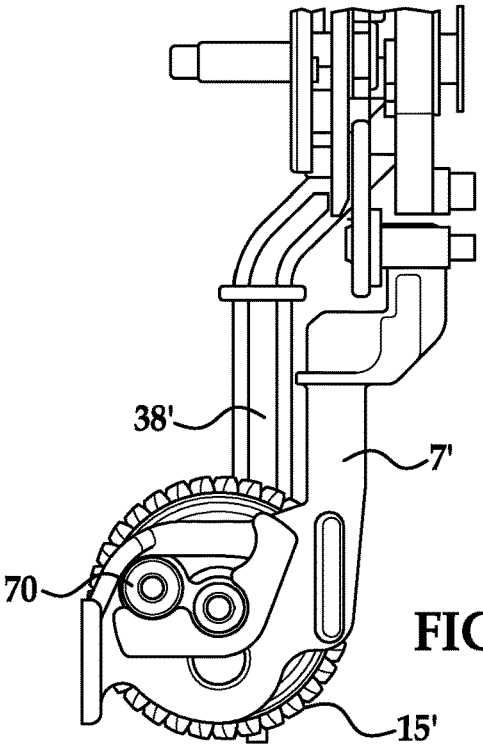
Figure 19:
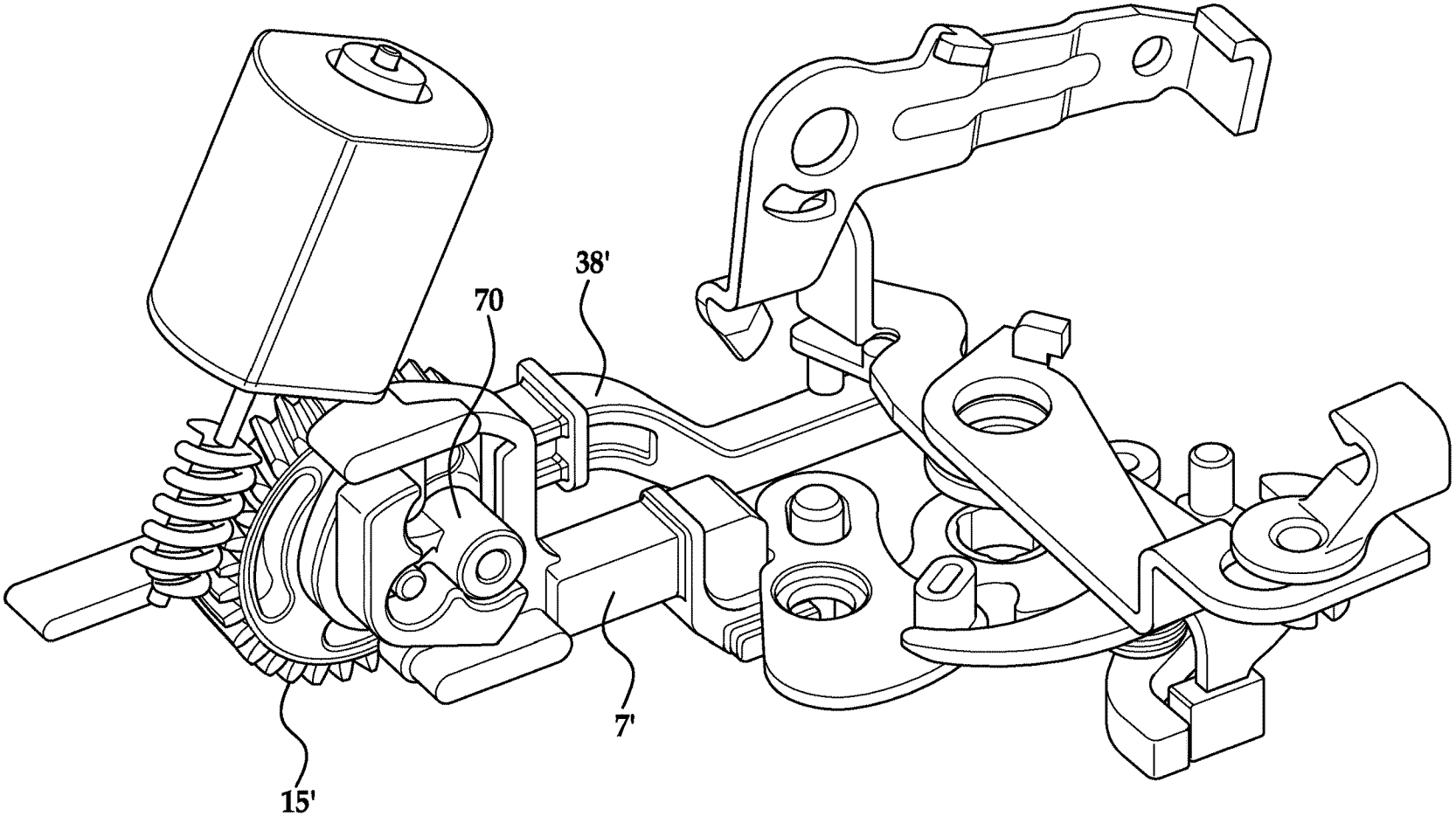
FIG. 19 is perspective view of the mechanism illustrated in FIGS. 18A-18E.

Referring now to FIG. 17 and in order to further illustrate this feature, the blocking member 7 has a dwell portion 47 integral with its linear cam slot, thus the first motion of the release link, as mentioned above when the detent blocking member 7 is in the engaged position 7 applies no work or force to the blocking member.

Moreover and as illustrated, integral cam driving feature 12 is received within the linear cam slot 10 of the sliding rack 11 thus the first release motion of the release link 38 moves the dwell portion 47 to the position 48 and no work or movement is applied to the blocking member. However and upon a second release motion of the release link, the dwell portion 47 is moved from position 48 to position 49 and the blocking member is now driven to its disengaged position illustrated by reference numeral 50. Then a subsequent third release motion of the release link would release the detent lever from its latched position.

Accordingly, the system illustrated in FIGS. 14-17 employs a three release motion event to fully release the latch from the vehicle body, when the detent blocking member 7 is in the engaged position and the release mechanism is actuated.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch system for a door of a vehicle, said latch system comprising:

a latch assembly;

an accelerometer configured to measure acceleration of the vehicle; and a controller communicatively coupled to said accelerometer, said controller configured to control an operation of said latch assembly, wherein said controller prevents transition of said latch assembly to a disengaged position when a disengage signal is received by the controller and the measured acceleration exceeds a predetermined threshold to facilitate preventing the door from opening, wherein the controller delays and repeats a comparison of the measured acceleration with the predetermined threshold for an 'n' number of attempts when the measured acceleration exceeds a predetermined threshold and wherein if the measured acceleration exceeds the predetermined threshold after the 'n' number of attempts, the controller will prevent the transition of said latch assembly to the disengaged position until another disengage signal is received by the controller.

2. The latch system of claim 1, further comprising a first power supply and a second power supply, wherein said controller is configured to determine whether the first power supply is present and to select said second power supply for operation of said latch assembly.

3. The latch system of claim 2, wherein said controller selects said first power supply for operation of said latch assembly when said first power supply is sufficient to operate said latch assembly.

4. The latch system of claim 2, wherein said first power source is a vehicle primary power source.

5. The latch system of claim 2, wherein said second power source is an electrical energy storage device.

6. The latch system of claim 1, further comprising a vehicle body controller communicatively coupled to said controller, said vehicle body controller configured to send an engage signal and a disengage signal to said controller.

7. The latch system of claim 6, wherein said controller engages said latch assembly using a first power supply upon receiving the engage signal, and said controller disengages said latch assembly when the measured acceleration does not exceed the predetermined threshold and upon receiving the disengage signal.

8. The latch system of claim 1, wherein said controller comprises a processor, said processor configured to execute a continuous loop algorithm.

9. The latch system of claim 8, wherein said algorithm directs the controller to determine whether:

an engage signal is received;

a disengage signal is received;

the measured acceleration exceeds the predetermined threshold;

a power supply for the latch assembly is present;

a power supply loss has occurred; and said latch assembly is disengaged.

10. The latch system of claim 1, wherein said latch assembly comprises:

a forkbolt capable of movement between a latched position and an unlatched position;

a detent lever capable of movement between an engaged position and a disengaged position, said detent lever retains said forkbolt in the latched position when said detent lever is in the engaged position and an engagement surface of said detent lever contacts an engagement surface of said forkbolt; and an inertia block out assembly for preventing said detent lever from moving into the disengaged position when said inertia block out assembly is in a blocking position.

11. A vehicle comprising:

a door; and a latch system for said door, said latch system comprising:

a latch assembly;

an accelerometer configured to measure acceleration of the vehicle; and a controller communicatively coupled to said accelerometer, said controller configured to control an operation of said latch assembly, wherein said controller prevents transition of said latch assembly to a disengaged position when a disengage signal is received by the controller and the measured acceleration exceeds a predetermined threshold to facilitate preventing the door from opening, wherein the controller delays and repeats a comparison of the measured acceleration with the predetermined threshold for an 'n' number of attempts when the measured acceleration exceeds a predetermined threshold and wherein if the measured acceleration exceeds the predetermined threshold after the 'n' number of attempts, the controller will prevent the transition of said latch assembly to the disengaged position until another disengage signal is received by the controller.

12. The vehicle of claim 11, further comprising a vehicle body controller communicatively coupled to said controller, said vehicle body controller configured to send an engage signal and the disengage signal to said controller.

13. The vehicle of claim 12, wherein said controller engages said latch assembly using a first power supply upon receiving the engage signal, and said controller disengages said latch assembly when the measured acceleration does not exceed the predetermined threshold and upon receiving the disengage signal.

14. A method of controlling a latch assembly for a door of a vehicle, said method comprising:

communicatively coupling a controller to the latch assembly;

communicatively coupling an accelerometer to the controller;

measuring, with the accelerometer, an acceleration of the vehicle; and determining whether or not to disengage the latch assembly based on whether the measured acceleration exceeds a predetermined threshold when the controller receives a disengage signal, wherein the controller delays and repeats a comparison of the measured acceleration with the predetermined threshold for an 'n' number of attempts when the measured acceleration exceeds the predetermined threshold and wherein if the measured acceleration exceeds the predetermined threshold after the 'n' number of attempts, the controller will prevent the transition of said latch assembly to a disengaged position until another disengage signal is received by the controller.

15. The method of claim 14, further comprising engaging the latch assembly using a power supply if the controller receives an engage signal.

16. The method of claim 14, further comprising disengaging the latch assembly using a power supply if the controller receives the disengage signal and the measured acceleration is below the predetermined threshold.

17. The method of claim 14, further comprising determining if a power supply loss is observed in a first power supply.

18. The method of claim 17, further comprising disengaging the latch assembly using a second power supply if the first power supply power loss is observed and the measured acceleration is below the predetermined threshold.

19. The method of claim 14, further comprising determining whether a power supply is present.

20. The method of claim 19, further comprising engaging the latch assembly if the measured acceleration exceeds the predetermined threshold, the power supply is present, and the latch assembly is disengaged.

* * * * *